United States Patent [19]

Kirsch

[11] 4,294,460

[45] Oct. 13, 1981

[54] FOOT-PLATES FOR SKI-BINDINGS

[76] Inventor: Bernhard Kirsch, Im Litzelholz 23, 5500 Trier-Biewer, Fed. Rep. of Germany

[21] Appl. No.: 960,662

[22] Filed: Nov. 14, 1978

[30] Foreign Application Priority Data

Nov. 23, 1977 [DE] Fed. Rep. of Germany ..... 2752206

[51] Int. Cl.[3] ..... A63C 9/00

[52] U.S. Cl. ..... 280/607; 280/617; 280/636; 403/121; 403/131

[58] Field of Search ..... 280/617, 607, 618, 636, 280/11.14; 403/121, 131, 122

[56] References Cited

U.S. PATENT DOCUMENTS 3,797,844 3/1974 Smolka et al. ..... 280/617

4,139,214 2/1979 Meyer ..... 280/617 X

*Primary Examiner*—Joseph F. Peters, Jr.

*Assistant Examiner*—Michael Mar

*Attorney, Agent, or Firm*—Ward Brown; Douglas E. Winters; Robert W. Beach

[57] ABSTRACT

A foot-plate for a ski-binding is intended for arrangement at a distance above the surface of a ski and carries the parts of the binding to grip the sole of a ski-boot at front and rear. The foot-plate is connectable to the ski by resilient members to be oscillatory in all directions in its own plane, and also preferably perpendicularly to the surface of the ski. The resilient members may take the form of inserts or bearers, and the foot-plate is advantageously recessed and in each of the recesses there is arranged a resilient member having an aperture for a connecting screw to pass therethrough. These resilient members at the front and rear sections of the foot-plate may have different degrees of resilience.

17 Claims, 23 Drawing Figures

FOOT-PLATES FOR SKI-BINDINGS

BACKGROUND OF THE INVENTION

The present invention relates to foot-plates of the kind which are arranged at a distance above the surface of a ski and which carry those parts of a ski binding which grip the sole of the ski-boot at front and rear.

It is known to mount the front binding and heel binding, which grip the sole of the ski-boot, solidly on a plate and to secure the plate to the surface of the ski. In one known arrangement the plate is arranged at a distance above the surface of the ski in such a way that at one point it is connected to the ski with no mobility in the longitudinal direction of the latter while at another point it is guided on the ski by means of a slide bearing which operates in the longitudinal direction of the ski, the slide bearing allowing relative movement in both senses in the longitudinal direction of the ski on the part of the section of the plate guided on it from a central position defined by the ski when unflexed.

Thorough tests have shown that this known arrangement allows the ski to flex without having any effect on the parts of the ski-binding, but nevertheless the numerous oscillations which occur while skiing as a result of sideways stresses on the ski are transmitted to the plate, and thus to the parts of the binding, undiminished. These fairly moderate sideways oscillations do not cause the ski-binding to release but do place an excessive strain on the bones and joints of the skier.

It is therefore an object of the invention to provide a ski-binding foot-plate of the kind hereinabove described in such a way that, when fitted the moderate oscillations which occur in the ski are absorbed and damped out so that they are not transmitted to the parts of the binding.

SUMMARY OF THE INVENTION

Accordingly, in a foot-plate for a ski-binding of the kind intended for arrangement at a distance above the surface of the ski and which carries the parts of the binding to grip the sole of a ski-boot at front and rear, the invention consists in the foot-plate being connectable to the ski by resilient members to be oscillatory in all directions in its own plane.

Advantageously, the plate is also connectable to the ski in such a way as to be able to oscillate perpendicular to the surface of the ski when fitted.

Advantageously, the plate has recesses in each of which is arranged a resilient member such as an insert with an aperture for a connecting screw to pass through. The resilient members may also be in the form of bearers or the like and at the front and rear sections of the foot-plate they may be have different degrees of resilience.

In an advantageous refinement, at least one of the recesses contains a shoulder on which the resilient insert rests. This recess is preferably oval in shape, with the long axis of the oval extending parallel to the longitudinal axis of the ski. The bottom portion of each recess is advantageously in the form of a funnel pointing toward the surface of the ski.

In a further embodiment the resilient member such as an insert, bearer or like, is in the form of a strip extending transversely to the longitudinal direction of the ski. Advantageously, where the member is in the form of an resilient insert, it has a rigid cap.

Preferably the foot-plate has on its underside, which is to rest on the surface of the ski, knob-like projections through which the connecting screws referred to above, can project.

Where the resilient members are in the form of bearers, they may be arranged between the foot-plate and the ski and be firmly connected both to the foot-plate and the ski when fitted.

Preferably, such resilient bearers are more resilient in the longitudinal direction of the ski than in a direction transversely to its longitudinal direction. Advantageously, the resilient bearers are interengaged with the knob-like projections referred to, or with transversely extending ribs or the like.

In a further advantageous embodiment, the resilient bearers are in strip-like form and are arranged on both sides of the knob-like projections, ribs or the like.

BRIEF DESCRIPTION OF THE DRAWINGS

In order that the invention may be more clearly understood, reference will now be made to the accompanying drawings which show certain embodiments thereof by way of example, and in which.

DETAILED DESCRIPTION OF PREFERRED EMBODIMENTS

Figure 1:
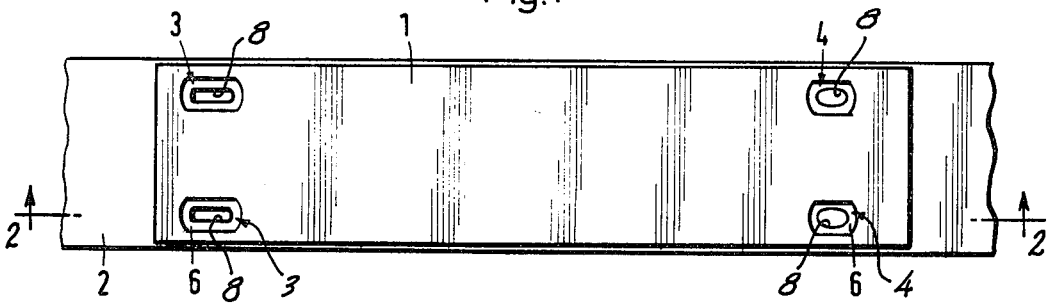
FIG. 1 is a plan view of a foot-plate on which the parts of a ski-binding can be mounted.
Figure 2:
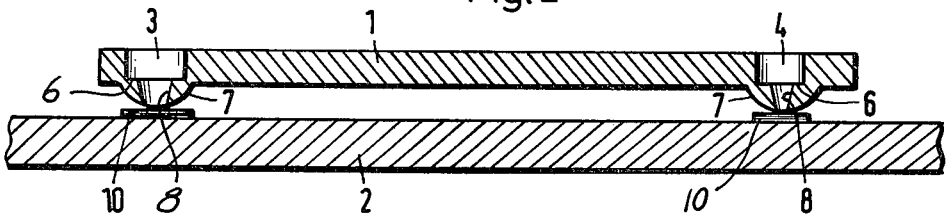
FIG. 2 is a section taken along line 2—2 of FIG. 1.
Figure 3:
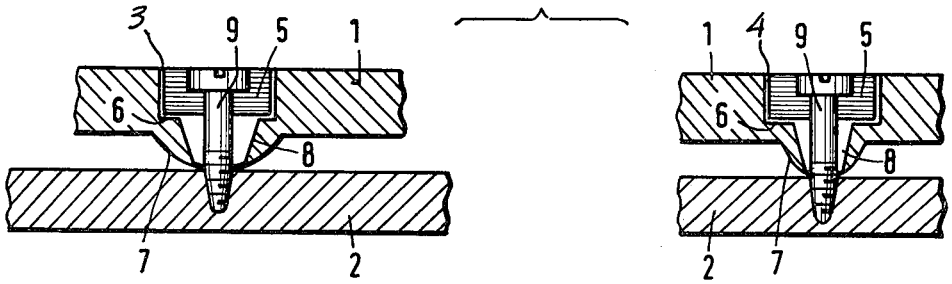
FIG. 3 is an enlarged fragmentary vertical longitudinal section of the foot-plate shown in FIGS. 1 and 2, illustrating screw fixings for the foot-plate.

Referring now to the drawings, in FIGS. 1 to 3, a foot-plate 1, to which binding parts (not shown) which grip the sole of the ski-boot at front and rear are fastened, is arranged on the upper face of a ski 2. At front and rear, the foot-plate 1 has pairs of recesses 3 and 4 into which resilient members in the form of inserts 5 of pad or resilient or springy material can be inserted, as shown in FIG. 3.

Each recess 3 or 4 becomes narrower towards the bottom, thus forming a shoulder 6 on which the insert 5 rests, so that the insert cannot drop out of the foot-plate 1.

In the regions occupied by the recesses 3 and 4, knobs 7 are situated on the underside of the foot-plate 1. These knobs 7 each contain a bore 8 forming a continuation of one of the recesses 3 or 4, through which projects a screw 9 which is screwed into place through the insert 5 from above. The point of the screw 9 is securely held in the ski 2.

As FIGS. 2 and 3 show, it is advantageous for each bore 8 to be of funnel-like configuration.

In FIG. 2 a bearing surface 10 is provided between the knobs 7 and the surface of the ski 2.

As best seen in FIGS. 4 to 7, preferably the recesses 3 and 4 to receive the inserts 5 are elongated lengthwise of the ski. The inserts 5 of resilient material to be inserted in the recesses 3 and 4 preferably are circular, however, as a result of which, when the insert has been placed in its associated recess, it is compressed to a greater extent in the lateral regions 11 than in the front or rear region 12. What is achieved in this way is that resistance to sideways movement of the foot-plate relative to the ski is somewhat stronger than the resistance to longitudinal movement of the foot-plate relative to the ski occurring head-on.

Figure 6:
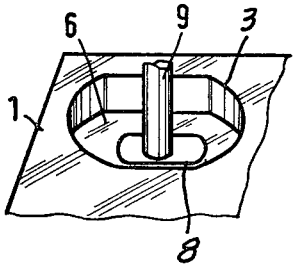
FIG. 6 is a fragmentary top perspective of another form of foot-plate illustrating modified recesses in the foot-plate.
Figure 4:
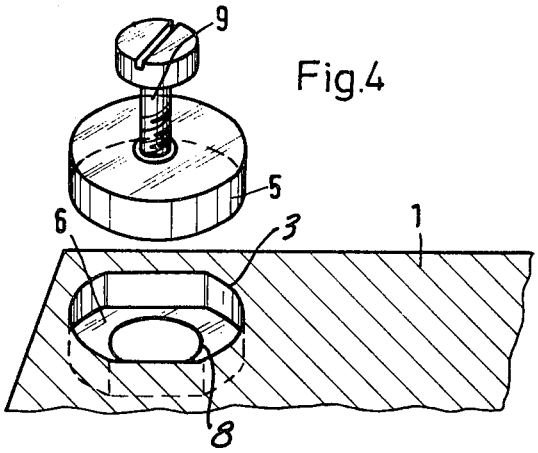
FIG. 4 is a somewhat exploded fragmentary top perspective view of the screw fixing of FIG. 3.
Figure 7:
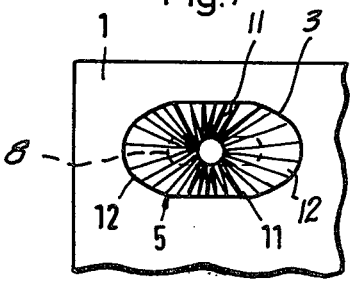
FIG. 7 is a somewhat diagrammatic plan view of the embodiment of FIG. 6 with a resilient member in the form of an insert in place.
Figure 5:
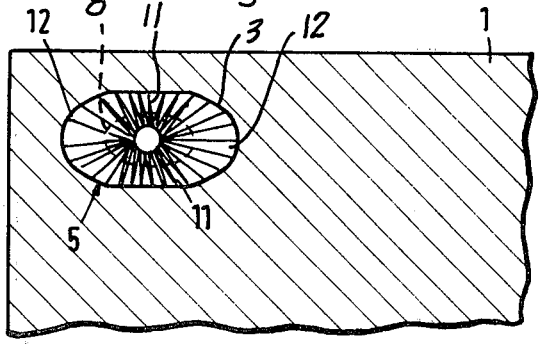
FIG. 5 is a somewhat diagrammatic fragmentary plan view of the screw fixing shown in FIG. 4.

As shown in FIGS. 4 and 5, bore 8 for the passage of the screw 9 can be generally circular, or as shown in FIGS. 6 and 7 such bore can be elongated lengthwise of the ski for producing directional guidance for the oscillatorily mounted plate 1.

Figure 8:
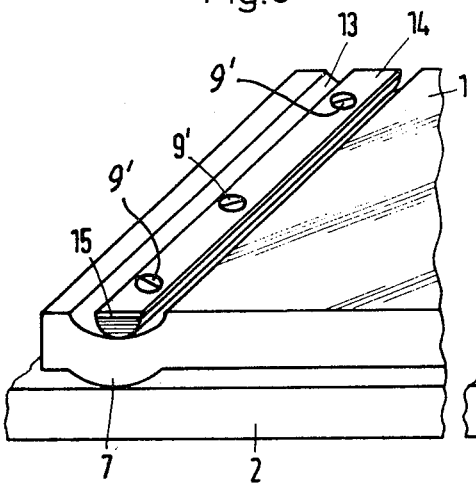
FIG. 8 is a fragmentary top perspective of another embodiment illustrating modified means for fixing the foot-plate to the ski.

In the case of the embodiment shown in FIG. 8, a transverse groove 13 is provided in the front and rear regions of the foot-plate 1 to act as a recess in which a pad or strip 14 of resilient material rests as an insert. On the strip rests a rigid cap 15. Projecting through the strip 14 and the cap 15 are screws 9', in which case a knob-like projection 7 may once again be provided on the underside of the plate 1.

Figure 9:
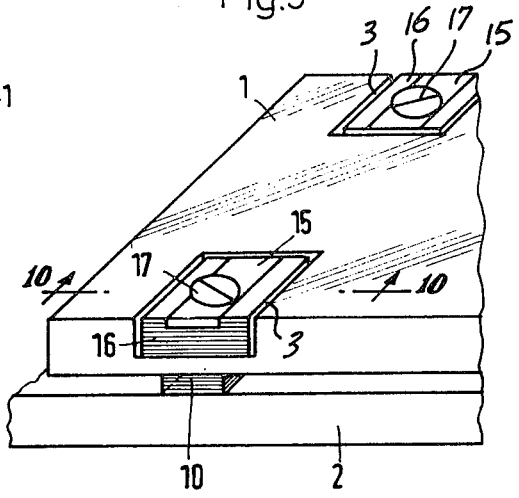
FIG. 9 is a fragmentary top perspective of a further embodiment of means for fixing the foot-plate to the ski.
Figure 10:
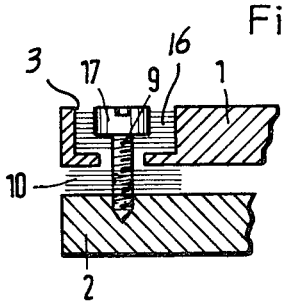
FIG. 10 is a section taken along line 10—10 of FIG. 9.

In the embodiment of FIG. 9, the resilient pads or inserts 16 extend to the lateral edges of the plate 1. The rigid metal cap 15 once again prevents the heads 17 of the mounting screws from penetrating too deeply into the resilient material of the insert 16. The cap 15 also distributes the pressure on the insert more uniformly, thus preventing any undesirable deformation of the resilient material.

Figure 11:
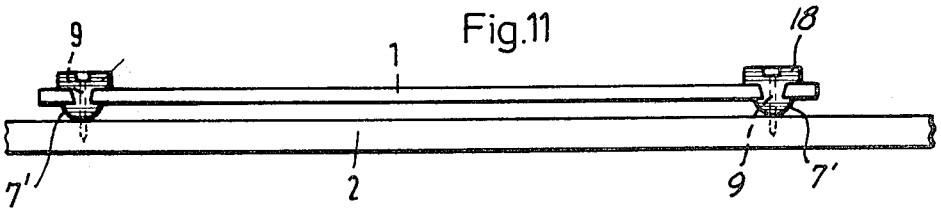
FIG. 11 is a side elevation of a further embodiment.
Figure 12:
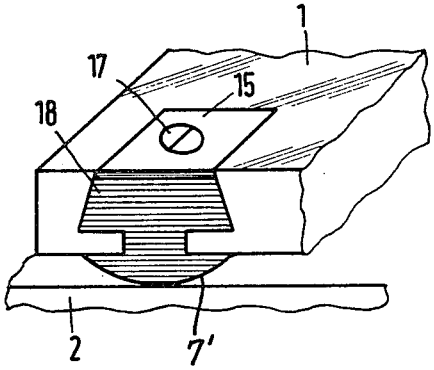
FIGS. 12 and 13 are corresponding fragmentary top perspectives showing modifications of the embodiment of FIG. 11.
Figure 13:
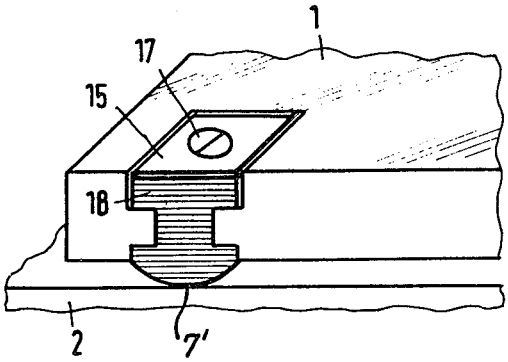

As can be seen in FIGS. 11 to 13, it is also possible for the foot-plate 1 to be mounted in specially shaped pads or bodies 18 of resilient material through which the screws 9 penetrate into the ski 2. In this case the knob-like projections 7' on the underside of the plate 1 are formed by the bottoms of the shaped bodies 18, which may be of various configurations as is shown in particular in FIGS. 12 and 13.

Figure 15:
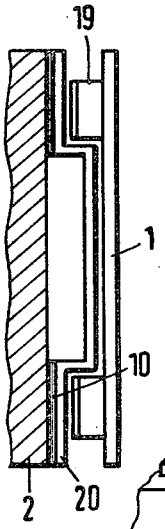
FIG. 15 is an end elevation of the embodiment of FIG. 14.
Figure 14:
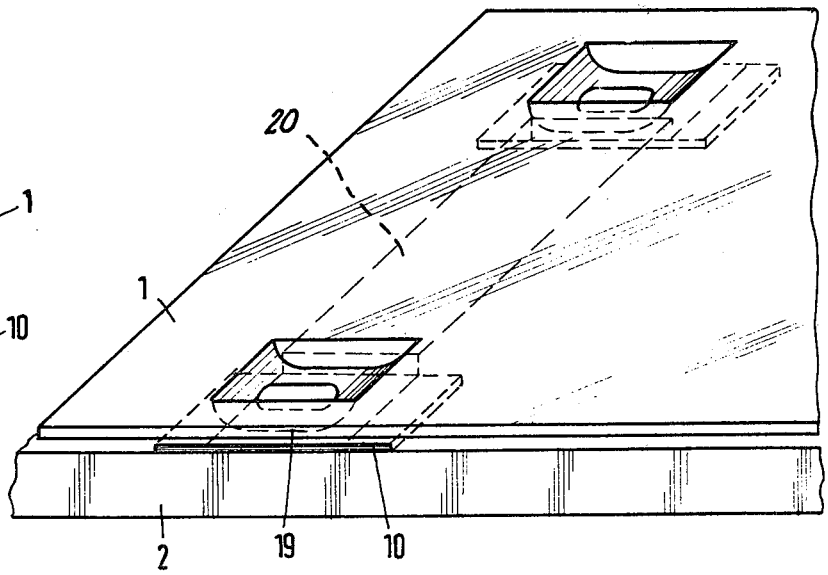
FIG. 14 is a fragmentary top perspective view of a further embodiment of a foot-plate which can be mounted on the ski.

In the embodiment of FIGS. 14 and 15, depressions 19 are formed in the foot-plate 1 whose undersides rest on the surface of the ski 2, in which case a suitably shaped mounting 20 may be provided between the surface of the ski and the plate 1.

Figure 16:
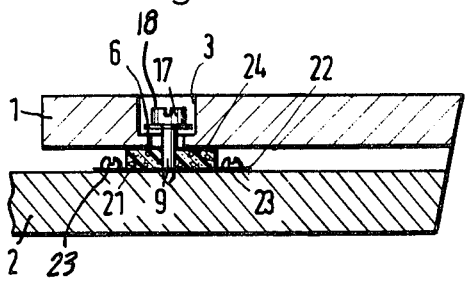
FIG. 16 is a fragmentary longitudinal vertical sectional view of another form of foot-plate having a resilient member in the form of a bearer.
Figure 17:
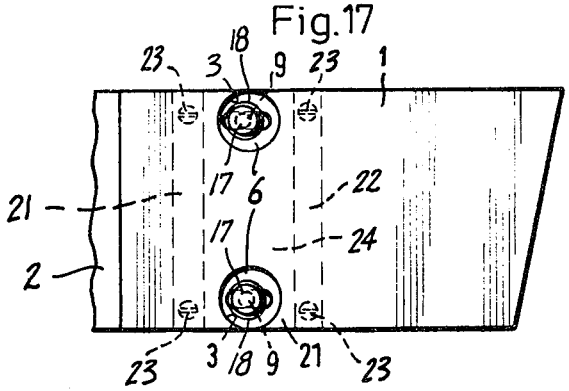
FIG. 17 is fragmentary plan view of the foot-plate shown in FIG. 16, FIGS. 18 to 20 are respective fragmentary longitudinal vertical sectional views of further embodiments of bearers.

In FIGS. 16 and 17 a resilient member in the form of a resilient pad or bearer 21 is fastened to the ski 2 by means of a carrier plate 22 and screws 23. The foot-plate 1 is firmly connected to the bearer 21 by a bonding agent 24. The foot-plate has recesses 3 in which are fitted screws 9 and washers 18. The bottom ends of the screws are secured to the carrier plate 22. The recesses 3 have shoulders 6 against which the washers 18 below the heads 17 of screws may abut when the foot-plate 1 has moved a certain distance in a direction perpendicularly away from the ski. In this way the screws 9 serve to prevent over-stretching of the resilient bearers.

The recesses 3, or at least their constricted lower sections, in the foot-plate are in the form of elongated holes extending in the longitudinal direction of the ski, thus allowing greater mobility in the longitudinal direction of the ski than in a direction transverse to such longitudinal direction. In addition to this the resilient bearers have greater resilience in the longitudinal direction of the ski than in a direction transverse thereto. Since in addition the bearers 21 extend for the entire width of the ski and this width is greater than the size of the bearers in the longitudinal direction, oscillations in a direction transverse to the longitudinal direction will, overall be damped to a greater extent than oscillations in the longitudinal direction.

Figure 18:
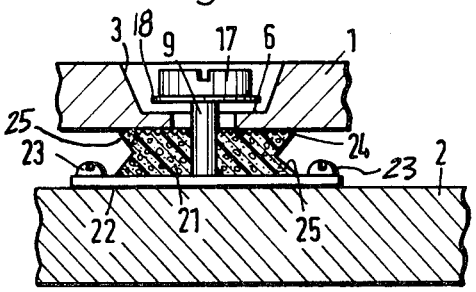
Figure 19:
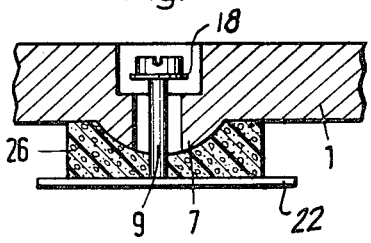

The bearers 21 in FIG. 18 have in their longitudinal sides V-shaped recesses 25 which provide the foot-plate 1 with greater mobility in the longitudinal direction of the ski, although large areas of connecting surface are still available between the bearers and the foot-plate and the bearers and the ski. In FIG. 19 resilient bearers 26 are interengaged with knob like projections 7 from the foot-plate 1. The projections 7 may alternatively be in the form of transversely extending ribs which would have the same cross-section as that shown. In this case two screws 9 are used to prevent the resilient bearers from being overstretched.

Figure 20:
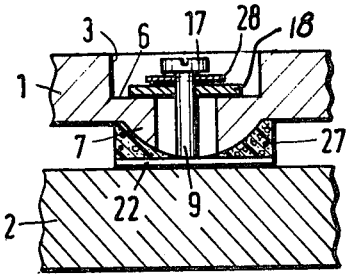

Whereas the screws 17 and washers 18 in FIGS. 16 to 19 allow the foot-plate to move in a direction perpendicular to the surface of the ski, the embodiments shown in FIGS. 20 to 23 only allow the foot-plate to move in its own plane. In FIG. 20 strip-like resilient pads or bearers 27 are interengaged with knob-like projections or ribs 7 from the foot-plate 1. The bearers 27 are mounted on carrier plates 22 which are rigidly connected to the ski 2. The knob-like projections are supported on the carrier plate 22. In recesses 3 in the carrier plate are arranged screws 9 whose heads 17 cooperate with the shoulders 6 in the recesses 3 and prevent the foot-plate 1 from moving in a direction perpendicular to the surface of the ski. Low-friction washers 28 are arranged between the screw-head 17 and washers 18 resting on the shoulders 6 to reduce friction.

Figure 21:
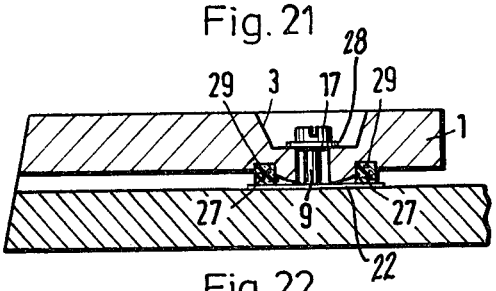
FIG. 21 is a fragmentary longitudinal vertical sectional view of bearers in strip form.
Figure 22:
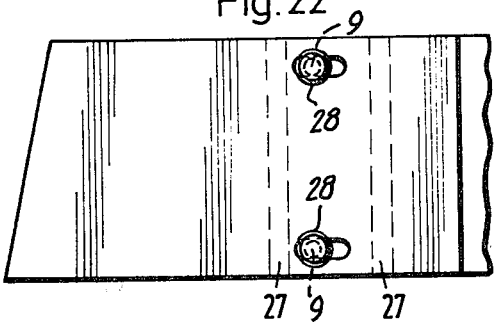
FIG. 22 is a fragmentary plan view of the bearers shown in FIG. 21.
Figure 23:
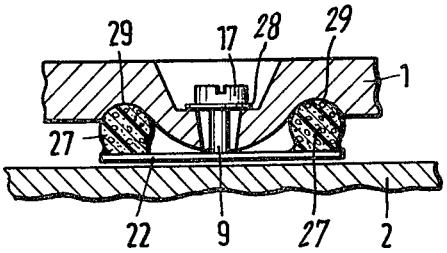
FIG. 23 is a fragmentary longitudinal vertical section of another embodiment of foot-plate having bearers in strip-form.

In FIGS. 21 and 22 the resilient, strip-like bearers 27 are of square cross-section, whereas in FIG. 23 the bearers are of keyhole-shaped cross-section. These bearers are engaged in corresponding recesses 29 in underside of the foot-plate 1.

I claim:

1. In a ski assembly, a foot-plate member for carrying a ski-binding, a substantially rigid member including a ski and rigid pin means including at least one rigid pin rigidly connected to said ski, said rigid pin having a portion projecting upward from the ski, said foot-plate member having an upright recess receiving said rigid pin projecting portion which recess is of a cross-sectional size substantially larger than the cross-sectional size of said rigid pin projecting portion in said recess for enabling movement during skiing of said foot-plate member relative to said ski a substantial distance in all directions laterally of the direction of projection of said rigid pin projecting portion, the upright sides of said recess limiting the maximum range of lateral movement of said foot-plate member relative to said substantially rigid member, and resilient means including at least one pad of resilient material interposed between said substantially rigid member and said foot-plate member for cushioning lateral movement of said foot-plate member relative to said substantially rigid member throughout the full range of relative lateral movement of said two members permitted by said rigid pin projecting portion in combination with the upright sides of said foot-plate member recess for cushioning the transmission of lateral forces exerted on said ski from being directly transmitted to said foot-plate member.

2. In the ski assembly defined in claim 1, the rigid pin allowing limited movement of the foot-plate member relative to the ski in a direction parallel to the direction of projection of the rigid pin projecting portion.

3. In the ski assembly defined in claim 1, the underside of the foot-plate member having a knob-like projection, and the pad of resilient material including a portion positioned between the foot-plate member knob-like projection and the upper surface of the ski.

4. In the ski assembly defined in claim 1, the underside of the foot-plate member having a knob-like projection, and the resilient means including strips of resilient material extending transversely of the ski and located, respectively, forward and rearward of the foot-plate member knob-like projection.

5. In the ski assembly defined in claim 1, the pad of resilient material being engaged between the rigid pin and the foot-plate member.

6. In the ski assembly defined in claim 1, the pad of resilient material being interposed between the underside of the foot-plate member and the upper surface of the ski.

7. In a ski assembly including a foot-plate member for carrying a ski-binding and mountable above the upper surface of a ski, the improvement comprising resilient means for mounting the foot-plate member on the ski for resilient oscillatory movement of the foot-plate member relative to the ski in all directions in a plane substantially parallel to the upper surface of the ski, the foot-plate member having a recess extending generally vertically, and said resilient mounting means including an insert of resilient material received in the recess and having an upright through aperture and rigid pin means including a projecting portion rigidly connected to the ski and extending through the resilient insert aperture.

8. In the ski assembly defined in claim 7, a rigid cap covering the top of the insert.

9. In the ski assembly defined in claim 7, the recess having upper and lower portions forming, respectively, an upper insert-receiving cavity having a bottom shoulder engaging the insert received in said cavity and a bore extending between said cavity and the bottom surface of the foot-plate member.

10. In the ski assembly defined in claim 9, the bottom portion of the recess being generally frustoconical and narrowing downward.

11. In the ski assembly defined in claim 7 or 1, the foot-plate member having at least two recesses located, respectively, at the forward and rear portions of the foot-plate member, the rigid pin means including at least two rigid pins having respective projecting portions received, respectively, in the foot-plate member recesses, and the resilient means including separate pads of resilient material engaged, respectively, between the rigid pin projecting portions and the forward and rear portions of the foot-plate member, said separate pads of resilient material having different degrees of resilience.

12. In the ski assembly defined in claim 7 or 1, the recess being elongated generally longitudinally of the ski.

13. In the ski assembly defined in claim 7 or 1, the underside of the foot-plate member having a knob-like projection, and the recess including an upright bore extending through said projection.

14. In the ski assembly defined in claim 7 or 1, the pad of resilient material being elongated transversely of the ski.

15. In the ski assembly defined in claim 7 or 1, the resilient means resisting movement of the foot-plate member relative to the ski and the resistance to longitudinal movement of the foot-plate member relative to the ski being weaker than the resistance to transverse movement of the foot-plate member relative to the ski.

16. In the ski assembly defined in claim 7 or 1, the pad of resilient material including a portion projecting below the bottom surface of the foot-plate member.

17. In the ski assembly defined in claim 16, the pad of resilient material including a portion positioned between the underside of the foot-plate member and the upper surface of the ski which portion is firmly connected to the foot-plate member and to the ski.

* * * * *

UNITED STATES PATENT AND TRADEMARK OFFICE

CERTIFICATE OF CORRECTION

PATENT NO. : 4,294,460

DATED : October 13, 1981

INVENTOR(S) : Bernhard Kirsch

It is certified that error appears in the above-identified patent and that said Letters Patent are hereby corrected as shown below:

Column 5, line 45, cancel "1" and insert ---5---.

Signed and Sealed this

*Twenty-ninth* Day of *December 1981*

[SEAL]

*Attest:*

GERALD J. MOSSINGHOFF

*Attesting Officer*

*Commissioner of Patents and Trademarks*